United States Patent [19]

Yildirim

[11] 4,406,499

[45] Sep. 27, 1983

[54] METHOD OF IN SITU BITUMEN RECOVERY BY PERCOLATION

[75] Inventor: Erdal Yildirim, Tulsa, Okla.

[73] Assignee: Cities Service Company, Tulsa, Okla.

[21] Appl. No.: 323,344

[22] Filed: Nov. 20, 1981

[51] Int. Cl.[3] ..... E21B 43/24; E21B 43/38; E21C 37/12; E21C 41/10

[52] U.S. Cl. ..... 299/17; 166/285; 166/292; 166/295; 166/298; 166/303; 166/306; 299/11

[58] Field of Search ..... 299/4, 5, 8, 11, 14, 299/17; 166/265, 285, 298, 303, 305 R, 306

[56] References Cited

U.S. PATENT DOCUMENTS

| | | | |
|---|---|---|---|
| 1,612,611 | 12/1926 | Claytor | 166/303 X |
| 1,851,565 | 3/1932 | Claytor | 299/8 |
| 1,886,886 | 11/1932 | Kelley et al. | 166/265 |
| 3,251,412 | 5/1966 | Cooke, Jr. et al. | 166/305 R X |
| 3,400,980 | 9/1968 | Dahms et al. | 299/5 |
| 3,402,967 | 9/1968 | Edmonds et al. | 299/5 |
| 3,858,654 | 1/1975 | Walker | 166/303 X |
| 3,894,769 | 7/1975 | Tham et al. | 166/305 R X |
| 3,951,457 | 4/1976 | Redford | 166/303 X |
| 4,033,412 | 7/1977 | Barrett | 166/305 R X |
| 4,034,812 | 7/1977 | Widmyer | 166/306 X |
| 4,212,353 | 7/1980 | Hall | 166/303 |
| 4,270,609 | 6/1981 | Choules | 166/303 |
| 4,325,579 | 4/1982 | Kwantes et al. | 299/5 |
| 4,366,988 | 1/1983 | Bodine | 299/17 X |

*Primary Examiner*—Stephen J. Novosad
*Assistant Examiner*—George A. Suchfield
*Attorney, Agent, or Firm*—George L. Rushton

[57] ABSTRACT

Bitumen is recovered from an underground tar sands (oil sands) formation by an in-situ percolation process. After drilling a borehole to the bottom of the tar sand formation, the hole is enlarged by radially hydraulic jetting, with the resultant slurry being removed to the surface. Then, the main body of the formation immediately surrounding the borehold is fragmented and slurried, forming a cell or chamber for in-situ processing. A system of small diameter, specially designed, flexible, perforated metal pipes is then introduced through the slurry mixture to the bottom of the chamber. As designed, the pipes flare radially outward as they descend, resulting in a set of pipes resting on or near the bottom of the chamber, pointing outwardly from the central pipe like wheel spokes. Processing material, such a hot alkaline water, is pressured through the pipe system and percolates upwardly through the slurry mixture, separating the bitumen from the sand matrix. The crude bitumen is collected at the top of the processed slurry and pumped to the surface, for further treatment.

8 Claims, 6 Drawing Figures

VOID SPACE CREATION FROM INITIAL CAVITY

PERCOLATION AND REMOVAL OF BITUMEN

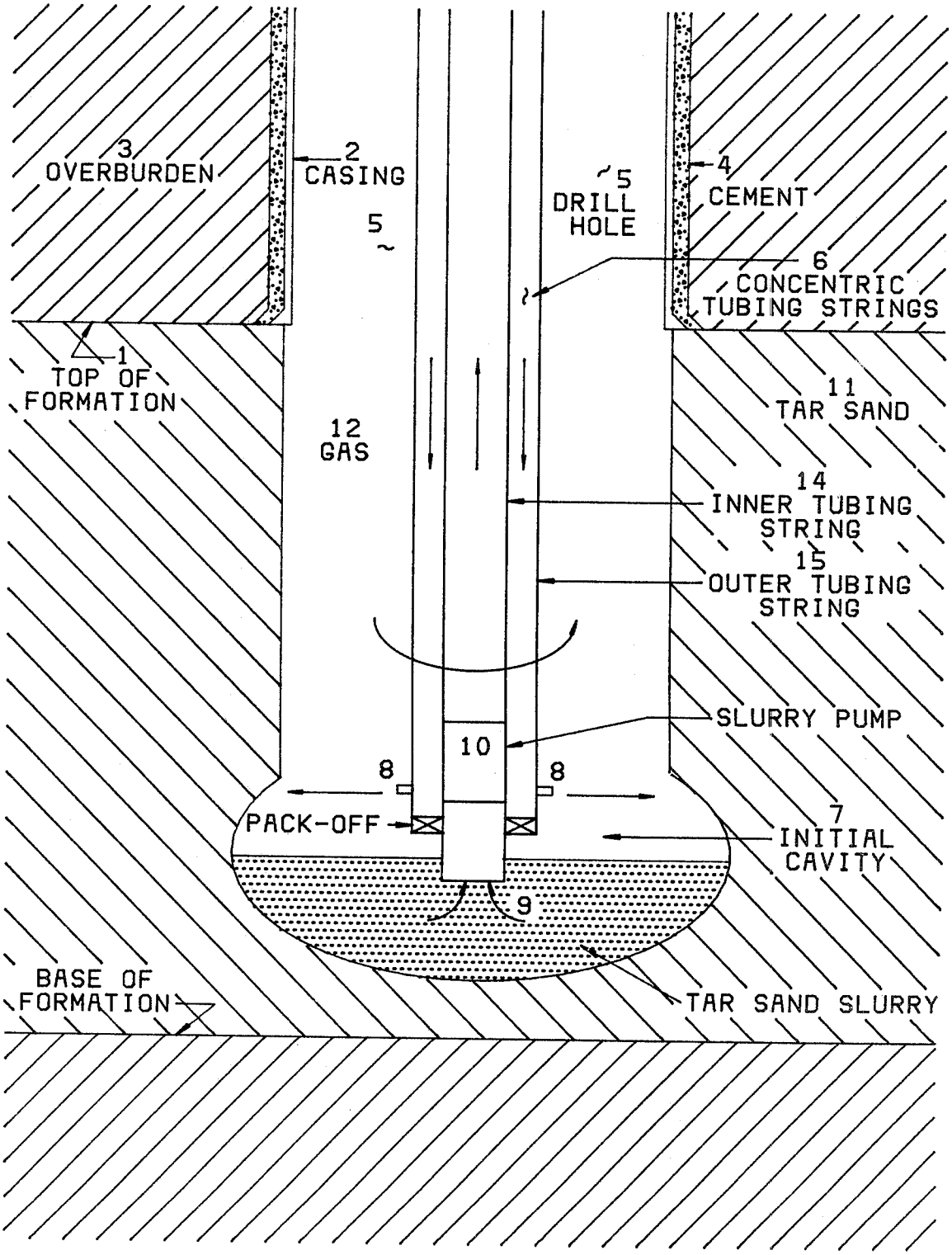
FIGURE 1 - VOID SPACE CREATION FROM INITIAL CAVITY

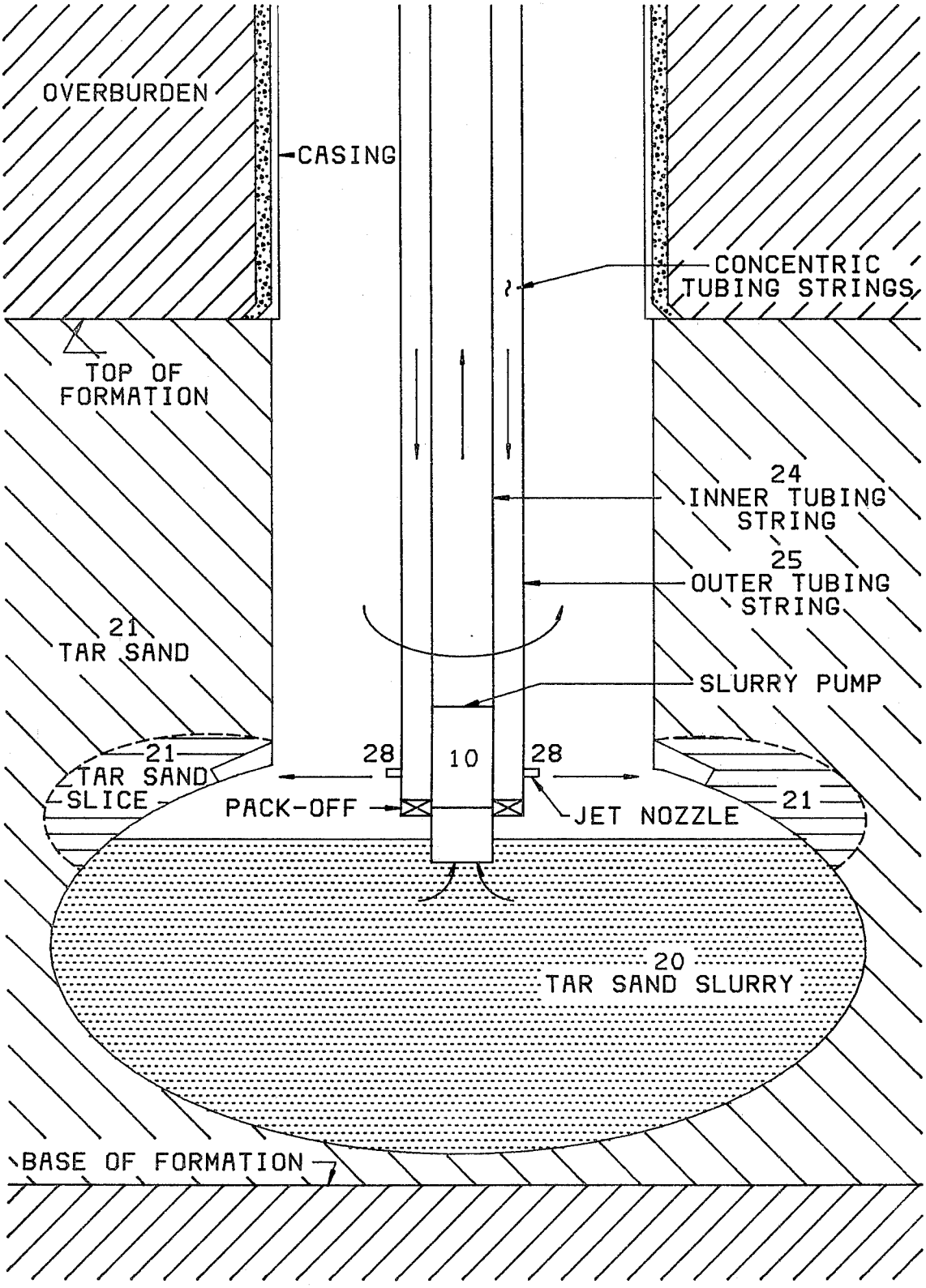
FIGURE 2 - HYDRAULIC CUTTING FOR PROCESSING

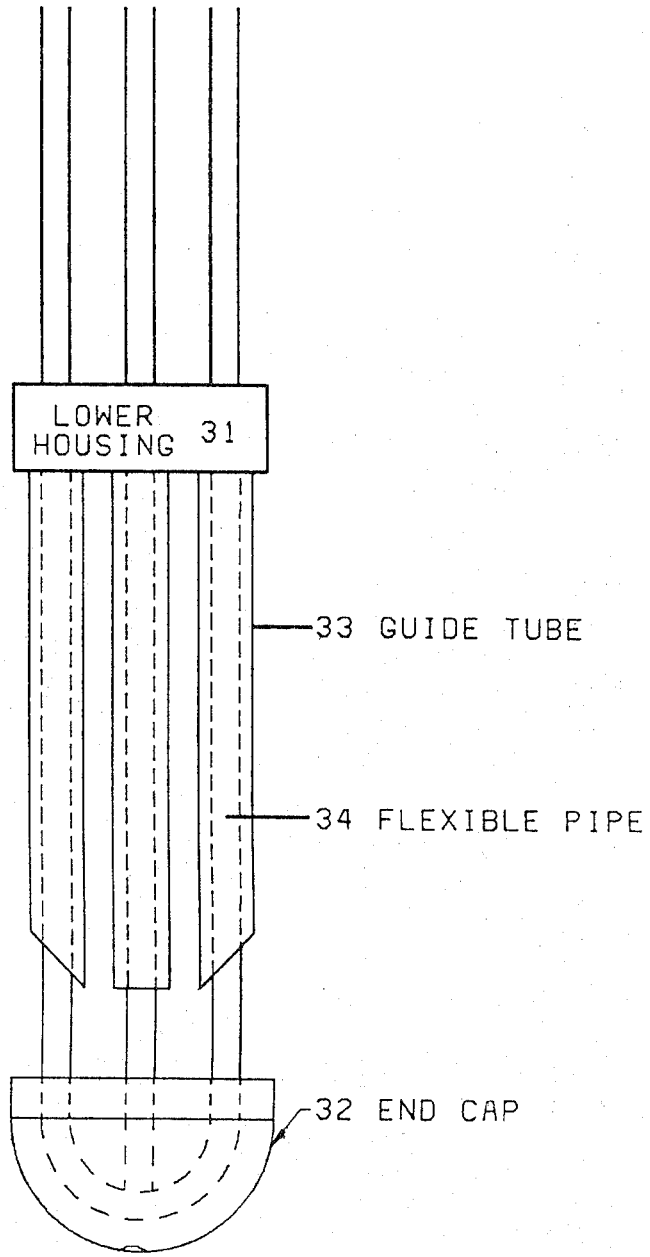
FIG. 3 - FLEXIBLE PIPE SYSTEM (INITIAL PACK)

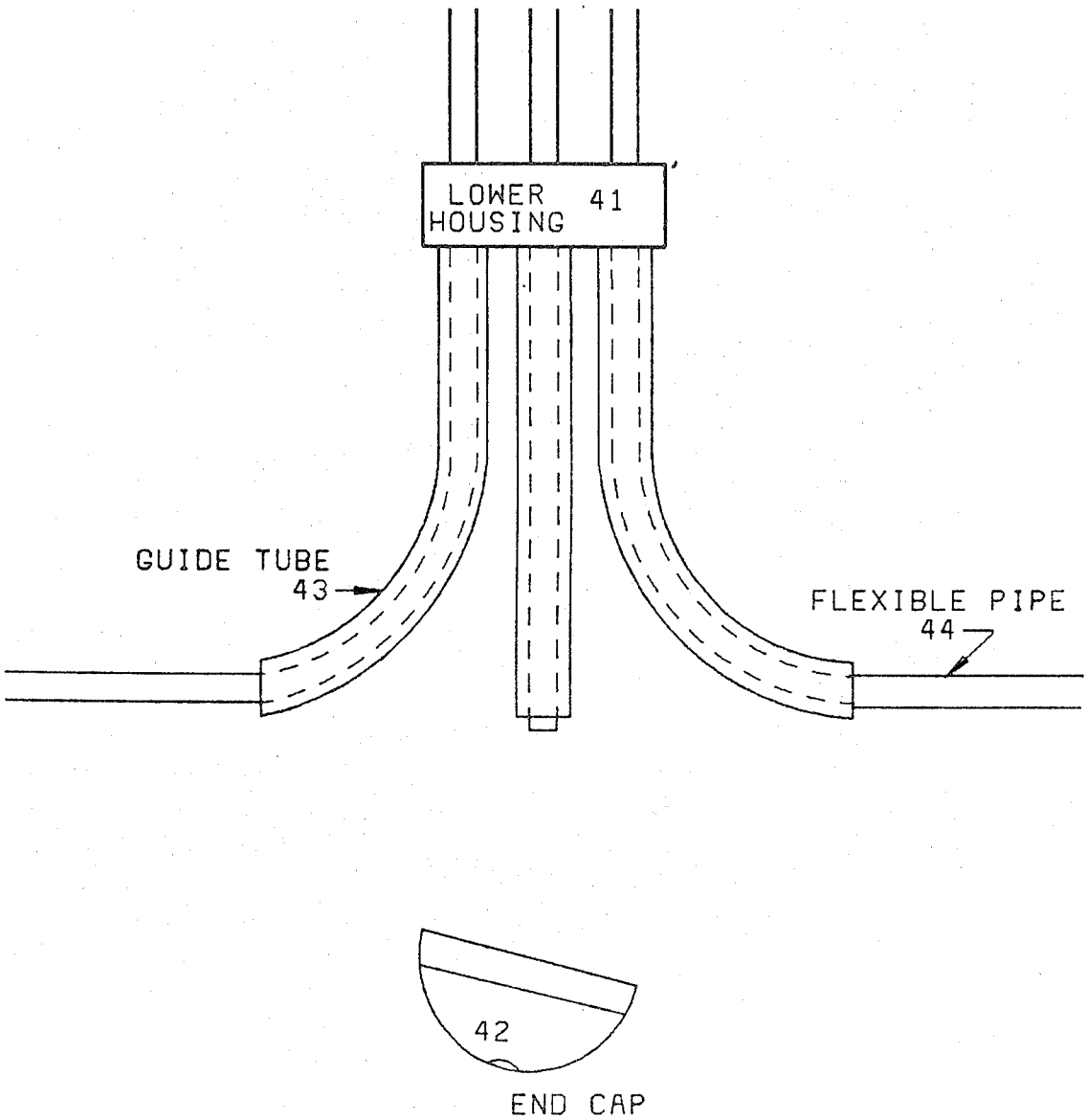
FIG. 4 - FLEXIBLE PIPE SYSTEM (OPENING AFTER THE KICK-OFF OF THE END CAP)

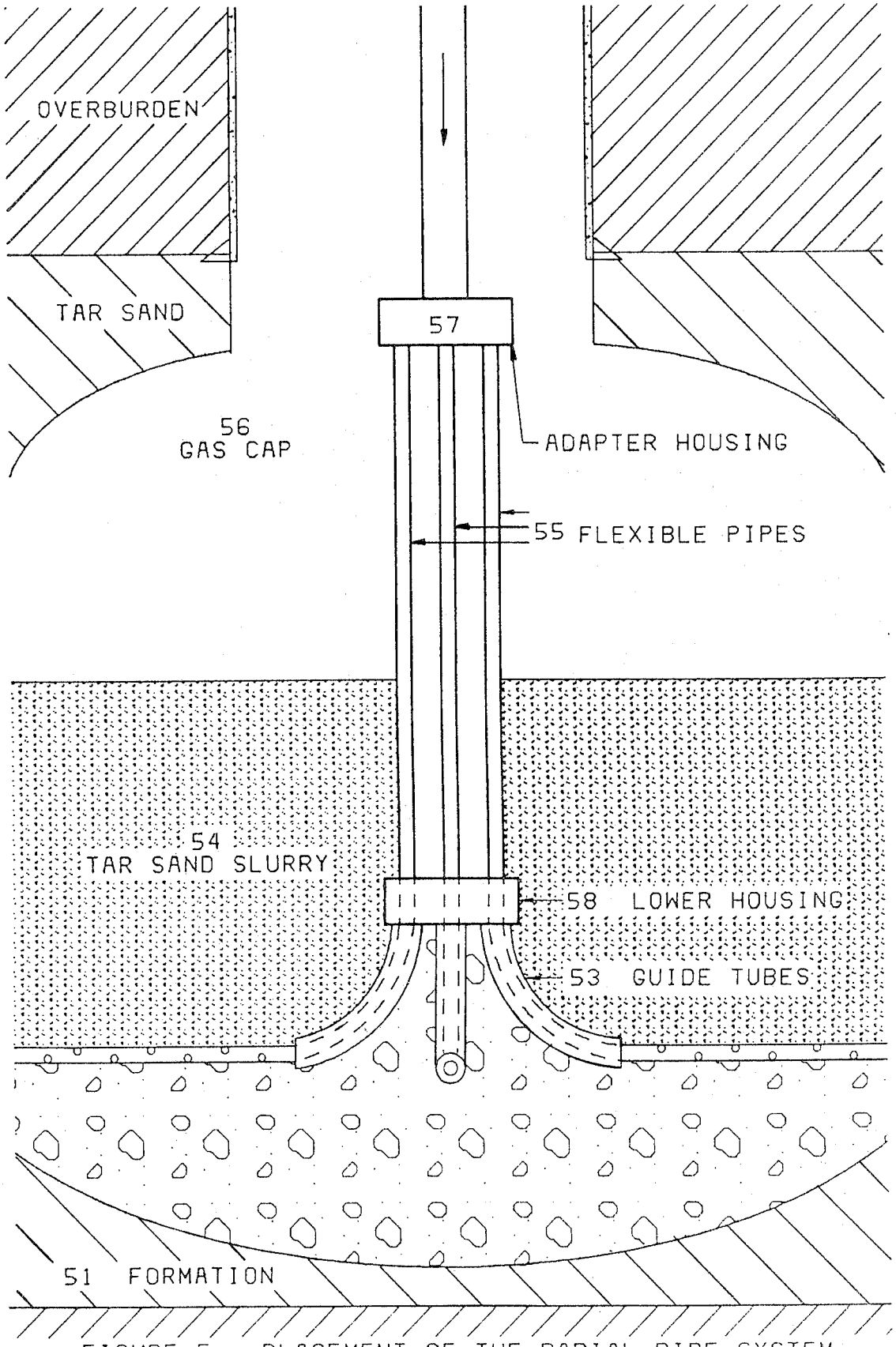
FIGURE 5 - PLACEMENT OF THE RADIAL PIPE SYSTEM

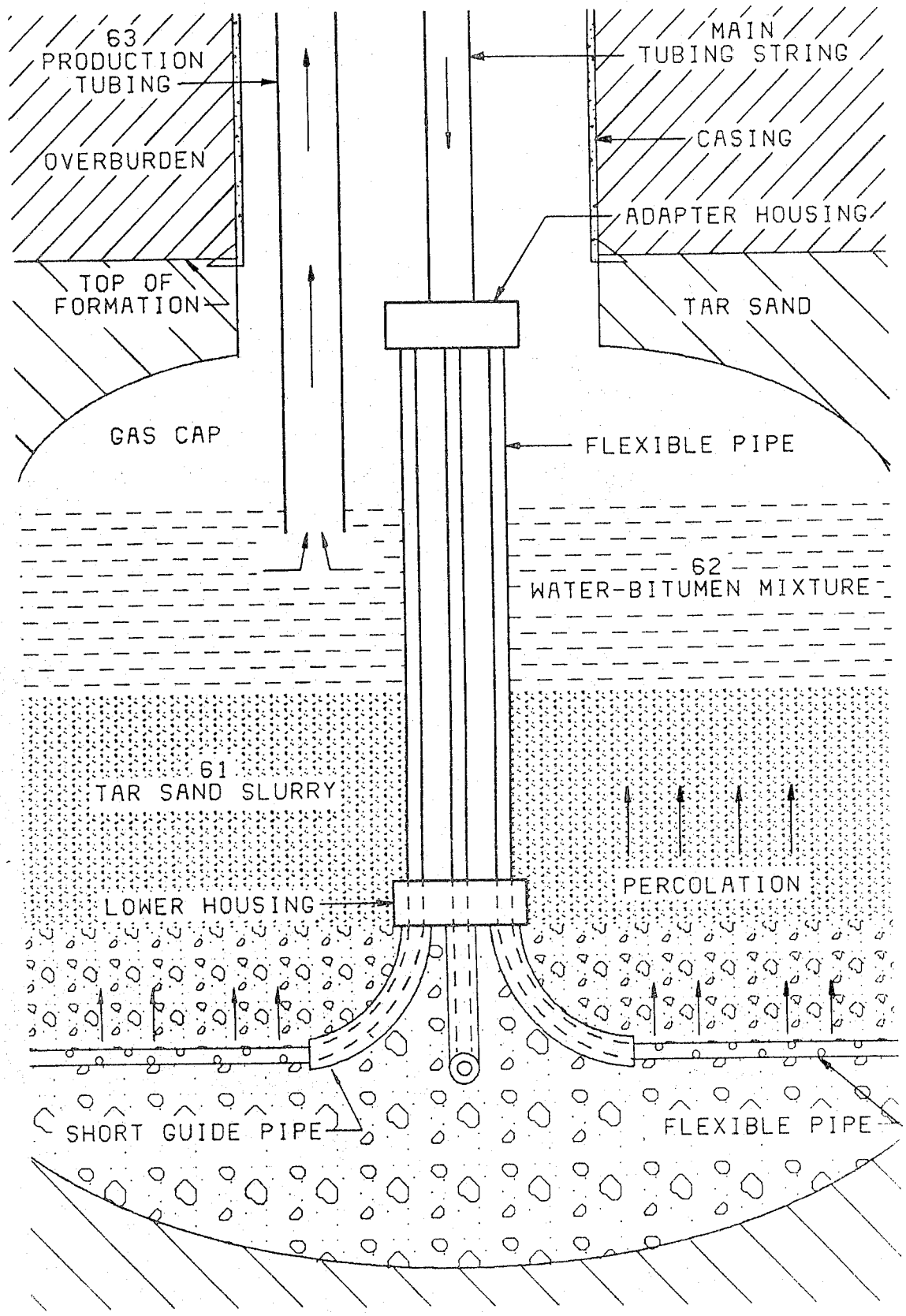
FIGURE 6 - PERCOLATION AND REMOVAL OF BITUMEN

METHOD OF IN SITU BITUMEN RECOVERY BY PERCOLATION

BACKGROUND OF THE INVENTION

This invention relates generally to a method for recovering heavy hydrocarbon materials from an underground, unconsolidated, carbonaceous formation. More particularly, the invention relates to an in-situ method of recovering bitumen from an underground tar sand (or oil sand) formation. The utility of the invention lies in the recovery of a crude hydrocarbonaceous material from an underground formation that is not amenable to methods of bitumen recovery as applied to surface or near-surface tar sand deposits. Broadly, this recovery process is applicable to a variety of solid or semi-solid natural resources which become fluid when heated (e.g., heavy oil such as found in Canada, sulphur, gilsonite, uintaite, etc.) or which will dissolve or slurry in a liquid solvent (e.g., uranium, coal, gypsum, etc.).

The process does not require surface or underground mining, beyond the preparation of a borehole, and can be applied to resources that are too deep for surface mining or which occur in formations that cannot be safely or economically mined by conventional methods. The process is most effective when the matrix of the host rock is semi-consolidated or of low strength, wherein the matrix can be broken down into smaller pieces. The Athabasca tar sands of Canada are used to illustrate the process.

Several tar sand projects in Canada are in, or near, production. Broadly, these projects involve surface mining methods in removing the tar sand for subsequent separation of bitumen from sand in an extraction plant. These operations involve large scale materials handling, bitumen extraction, tailings disposal, and reclamation steps. Further, these operations depend on the stripping of shallow overburden to uncover the tar sand deposits. Typically, these deposits vary in depth from about 100 to about 300 feet below the overburden and are thus designated as "shallow" deposits. On the other hand, tar sand deposits found at depths greater than about 300 feet, such as from about 300 feet to about 2000 feet, require different procedures and technology.

For these "deep" tar sands deposits, some prior extraction schemes disclose conventional underground mining methods, such as block caving and long wall, with some innovations in design of mining methods or equipment. Other proposed processes utilize hydraulic mining and slurry removal from underground workings. But these methods have the disadvantages of (a) the incompetency of tar sand formations, (b) the peculiar characteristics of rock mechanics of the formations above the tar sands, (c) the impracticality of the large volumes of tar sands (100,000–300,000 tons/day) required from underground mining, and (d) the relatively high mining costs of underground mining.

Mine assisted in-situ bitumen or heavy oil recovery techniques have also bee suggested. The underground workings provide the close proximity to the oil bearing formation for subsequent process steps, such as those to be carried out by a series of angled drilling holes from these underground workings in order to conduct thermal stimulation of the reservoir or to establish inter-well communication within the formation.

Some surface in-situ recovery methods are disclosed for either single well or multi-well applications. These methods offer the advantage of leaving the sand in the ground where it belongs and extracting the bitumen only, thereby reducing the large amounts of materials to be handled. Also, some of the environmental problems of surface mining operations, ground stability, and safety are eliminated or reduced.

Generally, the thermal methods for underground recovery have not been successful because considerable amounts of thermal energy and long periods of time are required to heat up the formation to give satisfactory viscosity and mobility of the desired product. In addition, non-homogeneous formations with clay layers or pockets, sand layers or lenses, and shale streaks often introduce a great deal of difficulty in heating the formation and displacing the bitumen uniformly. Low permeability causes problems in establishing fluid communication within the formation. Finally, heat losses to the overburden increase the heat energy requirements even more. Methods utilizing a solvent (or multi-solvents) to improve the permeability by dissolving the bitumen and freeing it from the rock matrix have not proven to be economically feasible. The initial cost of solvents and solvent losses to non-productive zones contribute to the high cost of these methods. Emulsification processes based on the use of hot water or steam, together with an alkaline additive to reduce viscosity, have been unsuccessful because of the limited area of penetration due to poor permeability.

In U.S. Pat. No. 4,114,687, an initial cavity is formed around a screen placed in the borehole, and a gravel pack slurry is then pumped down into the cavity, filling the cavity around the screen. The tar sands around the screen are washed with hot processing liquid, and the separated bitumen, filtered by the gravel pack, is pumped to the surface. In U.S. Pat. No. 4,124,074, a conical-shaped gravel pack is formed in the initial cavity, and a screen is run down through the cone apex to the bottom of the cavity. Then, hot processing liquid is added, and the melted bitumen flows through the gravel and screen to the surface. The present invention needs no such gravel pack or screen.

SUMMARY OF THE INVENTION

The present invention contemplates an in-situ method for producing bitumen or heavy oil from suitable formations at depths of more than 300 feet below the surface, the method avoiding or reducing the disadvantages of the abovedescribed methods. The process comprises the steps of:

(a) drilling a borehole, (b) creating a void space at or near the bottom of the borehole, by a cutting means and a removing means, (c) maintaining the integrity of the formation to avoid collapse of the formation, (d) enlarging the void space in both the horizontal and vertical directions, thereby enlarging the void space in the approximate shape of a cylinder to obtain a processing chamber, (e) continuing the cutting action of step (d) with the cutting means being traversed upwardly and rotationally, thus fracturing (cutting) the underground carbonaceous formation, to the upper limits of the formation, (f) forming a slurry filling at least a portion of the fractured space in the formation, (g) inserting a pipe system comprising a bundle of spring-loaded guide tubes into the slurry, the bundle being retained in a closed position by an end cap, with each guide tube enclosing a smaller diameter flexible tube, the flexible tubes being connected to a source of liquid processing material, (h) lowering the guide tube arrangement to the bottom (floor) of the slurry, (i) releasing the end cap, thus allowing the distal ends of the guide tubes to move outwardly in a generally horizontal direction normal to the axis of the bundle, thus inserting the guide tubes in the slurry, (j) introducing processing material through the inner flexible tubes, with the processing material contacting and separating, at least partially, the bitumen (heavy hydrocarbon material) from the remainder of the fractured material, forming lighter and heavier phases in the mixture, and (l) removing the lighter phase which contains the bitumen (heavy hydrocarbon material).

The present invention centers upon the idea of "percolating fluids through a permeable mineral zone". The permeable zone is created artificially by breaking the original rock matrix. The method includes the creation of an in-situ chamber to house the tar sand fragmented from the original rock matrix. A perforated and flexible pipe network is placed at the bottom of the chamber to provide the fluid injection needed for percolation through the permeable medium of the fragmented tar sand.

BRIEF DESCRIPTION OF THE DRAWINGS

FIG. 1 is a cross-section view showing the creation of a void space in a tar sand formation.

FIG. 2 is a cross-section view showing hydraulic cutting of the formation, to form an in-situ processing chamber.

FIG. 3 shows one aspect of the flexible pipe system, as a closed tube bundle or initial pack.

FIG. 4 shows the flexible pipe system in an expanded aspect.

FIG. 5 is a cross-section view showing how the expanded pipe system is located in the processing chamber.

FIG. 6 is a cross-section view of the processing chamber, showing the percolation step of obtaining bitumen.

DETAILED DESCRIPTION OF THE INVENTION

The purpose of the following process steps is to (a) establish a generally cylindrical chamber in the tar sand formation that will serve as an in-situ vessel for processing the fragmented tar sand, (b) introduce processing materials through a pipe system into the fragmented tar sand, (c) allow the processing materials to percolate through the permeable, fragmented column of tar sand, and (d) separate the bitumen from the tar sand matrix.

The floor of the chamber is generally of the shape of an inverted cone, with a gentle slope, and the roof of the chamber has an arched shape. The chamber is generally concentric with the drill hole from which it is formed. The ultimate height of the chamber is approximately that of the entire pay zone of the tar sand formation, and the radius of the chamber is in the range of 30–200 feet. After drilling the borehole, a void space equivalent to about 20–25% of the pay zone thickness is created, starting at the bottom of the drill hole. This void space provides the additional space needed for the expansion of the remaining tar sand column which is subjected to hydraulic cutting in a series of slices. Each slice of tar sand, when hydraulically and horizontally cut from the bottom of the central drill hole along the roof of the void space, fills a part of this space as a slurry of fractured material. And subsequent cuts increasingly fill the void space, until, at the end of the cutting process, the chamber that has been formed is practically filled with the fractured material.

As shown in FIG. 1, a vertical borehole (5) of large diameter, such as 10–16", preferably 12–14", is drilled from the surface to the top of the tar sand formation (1). Following good mining and drilling practices, a casing (2) is set in the overburden (3) and cemented (4), for good pressure containment. Then the borehole is extended below the casing through the tar sand formation (11). This borehole extension is completed without a casing in order to carry out further processing steps. This drill hole allows access to the tar sand and is a path for multi-tubing strings (6) which can carry equipment for fluids, solvents, or surfactants, both to and from the tar sand formation.

At the bottom of the borehole, in the tar sand formation, an initial cavity (7) is formed by enlarging the drill hole, such as by underreaming or open hole explosive shots. By using two concentric tubing strings (14,15) in the borehole, this initial cavity can be enlarged into a void space. In the tubing strings, the inner string extends a short distance below the outer string, and the outer string is sealed at the bottom. The outer string has two hydraulic jet nozzles (8), spaced 180° apart, close to the lower end of the string and which revolve with the tubing as the tubing rotates about its axis. The axis of each nozzle is normal to the axis of the outer tubing string. By rotating the outer string the jet nozzles create a void by hydraulic jetting, using water or some other suitable fluid. The impact of the high velocity jet streams on the unconsolidated and/or low strength formation material results in hydraulic cutting, thus causing the formation to be fragmented. These jet streams impinge on the walls of the initial cavity and make the cavity more uniform in shape covering a circular area. The area of erosion expands outwardly from the central hole as the jetting continues. Therefore, the hydraulic pressure at the nozzles is raised to achieve an effective and uniform hydraulic cutting as the void space enlarges.

To maintain the integrity of the formation and to avoid collapse, enough pressure must be maintained in the borehole and cavity to resist the pressure exerted by the overburden and formation. One means of maintaining internal pressure is by the introduction of gas (12), under pressure. The type of gas used is, broadly, one that is non-reactive, or of low reactivity, with the formation, the equipment used in the borehole, or the processing materials used. As a practical consideration, air is the most common gas that is available for this use. Nitrogen, alone or mixed with air, offers more inertness, but is more expensive. The internal cavity pressure should always be in approximate balance with the overburden load on the tar sand formation and should not greatly exceed the overburden pressure, which can be approximated as one psi per foot of thickness. The overburden pressure is meant to include the additional pressure of the unremoved tar sand formation. The use of gas in the cavity allows more efficient hydraulic jetting than does submerged jetting in a liquid.

After the creation of the initial void space, a plugging agent can be sprayed on the exposed surfaces of the formation to form a lining. This lining should seal, cover, or plug most of the cracks and fractures in the formation surrounding the void. Since this space constitutes the lowest part of the overall in-situ chamber that contains the fragmented and slurried tar sand, lining of the walls and floor of the void space should minimize possible leakage and fluid losses during subsequent process steps. As is known in petroleum well cementing technology, suitable agents for this lining can be chosen from cement, organic resins, or other comparable material.

During the formation of the in-situ chamber, an inverted conical surface can be established at the bottom of the void space by varying the hydraulic pressure at the nozzles, together with minimum changes at the angle of application of the jet streams on the cavity walls. Such an inverted conical bottom surface improves slurry collection. Similarly, an arching roof is established to give the roof a dome-like character, with resulting strength to resist collapse. As each new tar sand slice is hydraulically cut, the arching roof surface is recreated by proper application of the jet streams. FIG. 5 illustrates the general shape of the bottom surface (51) and the roof (52).

As jetting continues, in FIG. 1, the previously-available void space is filled with slurry (9), the mixture of the fragmented tar sand and the liquid from the jet nozzles. In the early stages of the overall process, this slurry can be pumped to the surface, either while additional jetting, cutting, and slurry formation is being carried out or after these operations are suspended. The slurry is removed from the bottom of the cavity by some pumping means, such as a slurry pump (10) located in the inner tubing string. When sufficient slurry has been removed from the cavity, pumping is stopped.

As shown in FIG. 2, when the radius of the circular cavity reaches the design radius of the ultimate void space, the concentric tubing strings (24,25) are raised to direct the jet nozzles (28) to a new slice of virgin tar sand (21). This cycle of hydraulic jetting and slurry formation continues until the total height of the initial cylindrical void reached the design height.

After the creation of the initial void space, similar cutting and fragmenting procedures are used to enlarge the chamber, generally in an upwardly vertical fashion. The objective of the creation of void space is to form an initial cavity into which slurry can flow, for future processing. The objective of additional cutting and slurrying after the formation of this initial void space is to form a suitable slurry (20) for processing in an in-situ cell or vessel. This cell is formed from the initial void space and the additional space made available by further cutting and removal of the "roof" of the void space.

A slice of tar sand (21) is hydraulically cut from the bottom of the column of virgin tar sand directly above the void space, that is, from the roof of the existing chamber. The slurry produced by this cutting flows by gravity into the void space already prepared.

After the hydraulic cutting of the first slice is completed up to the boundaries of the in-situ chamber and after the slurry from this slice has built up a moderate thickness, such as 5 or 6 feet, filling the bottom part of the void volume with slurry and with a gaseous atmosphere above the liquid surface, the concentric tubing strings are raised to that a new slice of tar sand can be cut. Thus, a new layer of slurry builds up on top of the previous layer, and this sequential cutting and slurrying continues until the entire column of tar sand has been fragmented and slurried. Then, the in-situ chamber is practically filled with the tar sand slurry.

The original concentric tubing string, with jets and slurry pump, is removed, and a radial pipe system is introduced into the chamber, using a single string of tubing or drill pipe. This pipe system is used in the processing of the accumulated slurry.

With the tar sand slurry available, processing of the slurry is initiated to separate the bitumen from the sand. In order to carry out an efficient bitumen separation, there must be a good slurry mixture, the tar sand particle sizes should be relatively small, such as from about 100 to about ¼ inch, and uniform, and there should be a minimum amount of tar sand lumps. The preferred particle size is the size of the individual tar sand grains. The slurry is more easily processed when the bitumen surface tension is reduced, forming small globules of bitumen froth. This change in the bitumen is promoted by raising the pH of the slurry and increasing the slurry temperature.

The in-situ processing of the slurried tar sands in the chamber can be carried out by the use of a radial, flexible pipe system. FIG. 3 shows the general appearance of this system, in the closed mode or initial pack. The total system, cylindrical in shape, comprises a plurality of pipes.

The pipe system is broadly separable into two parts, with the parts being connected into one operating unit.

The lower end of the drill string is connected to adapter housing (FIG. 5, 57), generally circular in shape. A plurality of flexible pipes 55 connects this adapter housing with a lower housing 58, a type of collar having openings through which the flexible pipes can pass. As in FIG. 4, to the lower ends of these openings, on the bottom side of the housing 41, are joined arcuate, rigid guide tubes 43 having a inside diameter greater than the outside diameter of the flexible pipes 44. Each guide tube provides a passageway for one flexible pipe. The distal end of each rigid guide tube is open and, if desired, is cut at an angle not normal to the axis of the tube.

As shown in FIG. 3, the closed mode of the pipe system has the guide tubes 33 and enclosed flexible pipes 34 drawn together in a bundle formation, with the distal ends of the tubes and pipes secured in portholes in the top of a hemispherical end cap 32.

As an example of the utility of this pipe network, it can be employed in the underground, in-situ processing of a tar sand formation. After a borehole has been sunk into the formation, an initial cavity, or enlargement of the lower end of the borehole, is formed. Additional work is done to increase the height of the cavity to the top of the tar and formation. After most of the material formerly found in this cavity is slurried, the apparatus used to form the cavity is removed from the borehole, and a tubing string, with the above-described pipe network, is lowered into the borehole, with the network at or near the bottom of the formed cavity. During the lowering operations, circulation of fluid in the closed mode of the flexible pipe system allows fluid, such as water, to flow under pressure through end cap 32, this flow assisting in the operation by a jetting action.

As shown in FIG. 4, by a separating means, such as an explosive charge or water pressure applied through one or more flexible tubes, the hemispherical end cap 42 is separated from the initial pack of the tube bundle. When the end cap is removed, the arcuate guide tubes 43, released from the binding tension, flare outwardly from the closed position so that there is approximately a 90° curvature in the 4–6 ft. length of each guide tube. As shown in FIG. 5, if the lower end of the network is not firmly seated in the cavity area, adjusting movements of the drill string are sufficient to locate the network properly. The lower housing 58 and the flared, rigid, arcuate guide tubes 53 thus become seated in the lower portion of the cavity. Using such a firm base for operations, the upper, or adapter, housing 57 is moved downwardly by the drill string, this movement forcing the flexible pipes 55 through and out of the guide tubes 53 and into the material at the bottom of the cavity. To ease the movement of the flexible pipes through this material, a fluid, such as water, can be pumped by suitable connections and apparatus down the drill string and into, through, and out of the flexible pipes, giving a jetting action at the distal end of the pipes and thus enabling the flexible pipes to be moved, in a generally horizontal manner, outwardly from the tube bundle to a distance approximately that of the chamber radius. In this manner, the placement of the radial pipe system, as shown in FIG. 5 is accomplished. In anticipation of their use as percolation pipes, the flexible pipes can have a multitude of holes previously drilled normal to the long axis of the pipes, with these holes temporarily sealed with some plugging agent, such as threaded magnesium plugs. This construction allows the pipes to be placed preparatory to the percolation step. At an appropriate time, an unplugging agent, such as 15% hydrochloric acid, is moved through the pipe, where it opens the previously-drilled holes. After these holes are opened, processing materials can be pumped through the pipes, with the pipes fitted with a threaded orifice plug at the distal end, to limit the materials from preferentially flowing out the ends of the open pipes. The processing materials then percolate through the slurry that lies above the pipes, due to fragmenting of the formation above the initial cavity.

A pipe system such as this is applicable to solution mining of appropriate mineral deposits.

With the processing chamber now practically filled with the tar sand slurry (54) (capped with a gas layer 56 on top) and the perforated pipe network embedded in the settled portion of the slurry at the bottom, the chamber can be considered as an in-situ tar sand processing vessel, or a cell, and is ready for extraction of bitumen.

The bitumen extraction is a sweep process carried out by percolation of processing materials through a permeable medium, as shown in FIG. 6. In this case, the permeable medium is the tar sand slurry (61). Orginally, the tar sand formation had a low permeability, but the operations of hydraulic cutting, fragmenting, and slurrying now offer an artificially permeable medium.

The preferred basic processing material or injection fluid is hot water. Mixtures of water and lower hydrocarbons (and their derivatives) can be used, but these mixtures offer certain disadvantages. Hydrocarbons in the $C_3$–$C_{10}$ range, and/or their alcohol, halide, and ester derivatives can be used as injection fluids. But hot water between the temperatures of about 175° F. and the boiling point at the pressure of the cell is the best known, least expensive, and most practical injection fluid. To promote the processing reactions, a surfactant is added to the injection fluid. Sodium hydroxide, although not commonly considered a surfactant, is used in this processing situation as it is used in an above-ground processing. The mixture of hot water and sodium hydroxide is injected through the perforated pipes into the slurry column and rises and percolates through the permeable column, heating the tar sand slurry. Since the chamber is pressured to maintain the integrity of the roof and walls, the injection pressure of the processing fluid will be higher than the pressure in the chamber. Due to this added pressure and also to the density difference, the injection fluid causes some agitation in the slurry mixture.

The effect of the sodium hydroxide as a surfactant results in a reduction of surface tension or viscosity reduction. This action, together with the heat energy supplied by the hot water, agitates, breaks, and separates the bitumen from the sand particles. The upward flow of the injection fluid provides the physical force to sweep the bitumen away from the heavier sand particles and transport the bitumen to the upper part of the cell. Gradually, a bitumen-rich mixture of water and bitumen, being of lower density, forms an upper layer (62) at the upper level of the slurry mixture. If a pressured gas, such as air or nitrogen, is also injected with the injection fluid, a bitumen froth is formed, which also aids in the separation. The bitumen-water mixture contains impurities such as clay or sand particles, along with surfactant. The residual slurry forms the lower layer, typically a majority of volume of the processing chamber. This "percolation" step can cover an extended time period, such as 2–3 weeks.

After agitation of the slurry mixture and percolation of the injection fluid through the slurry mixture, the bitumen-rich layer at the upper level of the slurry mixture is removed. This removal can be done in various ways. Another tubing string (63) parallel to that presently in use can be run down the hole. By proper placement of the tubing string, the bitumen-rich layer of the water/bitumen mixture is removed from the upper part of the vessel. The tubing string (63) is located below the end of the casing and above the settled portion of the mixture. Vertical movement of this string is easily accomplished by technology known in the art so that the desired layer can be removed.

With proper regulation of underground pressure, the stream of water-bitumen mixture flows through the tubing string to surface tankage. A removal step such as this is within the ability of one skilled in the art. Conventional equipment, such as a bottom hole pump and/or gas lift valve, can be used. By repeating the steps of injection of processing fluids and passage by percolation of the injected processing material through the slurry column, there are left behind some agglomerates of tar sand at the bottom of the chamber and a column of tar sand slurry containing lesser amounts of bitumen, with this slurry column filling most of the cell and with a gas cap on top. The flow rates of the injection fluid are regulated as these two process steps of injection and removal are repeated during the productive life of a cell. As more and more bitumen is removed, the bitumen concentration of the slurry in the cell gradually decreases. Thus, as the productive life of the cell lengthens, slower fluid injection rates are applied, in order to achieve an optimum bitumen yield from the remaining mixture. When the bitumen yield from a cell becomes negligible, production is stopped.

The shutdown of a depleted cell can be carried out in various ways. Some or all of the excess underground pressure can be relieved, and some of the equipment can be recovered from the chamber. The string of tubing used during the production portion is removed. Then, the flexible pipe system is removed from the cell by pulling or jarring the main tubing string, leaving the short guide pipes in the drill hole. If the flexible pipes cannot be pulled out, then the main tubing string is cut off above the adapter housing, suc as with a jet shot or chemical cutter. After removal of the tubing strings and pipes, a sand slurry can be poured into the cell to fill whatever void space is left at the completion of the production phase. By this, or by other methods, complete back filling of a cell can be achieved, thus minimizing any future surface subsidence, and the cell can be sealed off.

I claim:

1. An in-situ method for producing a crude heavy hydrocarbon material from an underground carbonaceous formation, comprising the serial steps of:

(a) drilling a borehole, (b) creating a void space at or near the bottom of the borehole, by a cutting means and a removing means, (c) maintaining the integrity of the formation to avoid collapse of the formation, (d) enlarging the void space in both the horizontal and vertical directions, thereby enlarging the void space in the approximate shape of a cylinder to obtain a processing chamber, (e) continuing the cutting action of step (d) with the cutting means being traversed upwardly and rotationally, thus fracturing (cutting) the underground carbonaceous formation, to the upper limits of the formation, (f) forming a slurry filling at least a portion of the fractured space in the formation, (g) inserting a pipe system comprising a bundle of spring-loaded guide tubes into the slurry, the bundle being retained in a closed position by an end cap, with each guide tube enclosing a smaller diameter flexible tube, the flexible tubes being connected to a source of liquid processing material, (h) lowering the guide tube bundle to the bottom (floor) of the slurry, (i) releasing the end cap, thus allowing the distal ends of the guide tubes to move outwardly in a generally horizontal direction normal to the axis of the bundle, thus inserting the guide tubes in the slurry, (j) introducing processing material through the inner flexible tubes, with the processing material contacting and separating, at least partially, the heavy hydrocarbon material from the remainder of the carbonaceous material, forming lighter and heavier phases in the mixture, and (k) removing the lighter phase which contains the heavy hydrocarbon material.

2. The method of claim 1 wherein (a) the underground formation is about 300 feet or more below the surface, (b) the cutting means is an hydraulic cutting means, (c) the removing means is a pumping means, (d) the integrity of the formation is maintained by the pressure of gas introduced into the void space, (e) the void space is enlarged by an hydraulic jetting means, (f) the void space has an arching roof, dome-like in character, thereby assisting in maintaining the integrity of the formation, (g) the heavy hydrocarbon material is selected from the group consisting of bitumen, heavy oil, and gilsonite, and (h) the underground formation is selected from the group consisting of tar sand or oil sand formation, heavy oil formation, and gilsonite formation.

3. The method of claim 2 wherein (a) the gas pressure is in approximate balance with the overburden and formation pressure, and (b) the gas used for pressuring is selected from the group of gases that is non-reactive, or of low reactivity, with the formation, the equipment used in the borehole, or the processing materials, (c) the enlarged void space has a radius of about 30–200 feet, (d) the initial void space has a height of approximately 20–25% that of the pay zone of the underground formation, and (e) the hydraulic cutting means uses water as the hydraulic fluid.

4. The method of claim 1 wherein (a) the pipe system comprises a plurality of flexible and arcuate-shaped pipes, aligned radially along a common axis, (b) the outermost ends of the outwardly-flared pipes are cut at an angle, (c) the pipe system is spring-loaded in the closed position, (d) the heavy hydrocarbon material is bitumen, and (e) the underground formation is a tar sand or oil sand formation.

5. The method of claim 1 wherein the integrity of the formation is maintained by lining the surface of the created void space by a plugging agent, a material that seals, fills, and plugs various imperfections in the exposed formation.

6. The method of claim 1 wherein (a) the processing material is selected from the group consisting of water, lower hydrocarbons, the alcohol, halide, and ester derivatives of said lower hydrocarbons, and mixtures thereof, (b) the processing material further comprises a promoter selected from the group consisting of sodium hydroxide, surfactant, and mixtures thereof, and (c) the processing temperature ranges from about 175° F. (about 80° C.) to about the boiling point of the liquid at the given cell pressure.

7. The method of claim 6 wherein (a) the pH of the processing mixture ranges from about 8 to about 9, and (b) a gas is added to the processing material introduced, said gas forming a froth that aids in separation of the bitumen.

8. The process of claim 1 wherein steps (j) and (k) are repeated.

* * * * *